US006065723A

United States Patent [19]

Skudelny

[11] Patent Number: 6,065,723

[45] Date of Patent: May 23, 2000

[54] MOUNTING ELEMENT FOR ACCESSORIES ON SHELVES

[76] Inventor: Kai Skudelny, Via della Miniera 8, 1-39018, Teriano, Italy

[21] Appl. No.: 09/005,853

[22] Filed: Jan. 12, 1998

[30] Foreign Application Priority Data

Jan. 14, 1997 [IT] Italy ..... BZ97A0001
Nov. 29, 1997 [IT] Italy ..... BZ970015 U

[51] Int. Cl.[7] ..... A47B 96/06

[52] U.S. Cl. ..... 248/231.31; 248/316.7

[58] Field of Search ..... 248/231.31, 310, 248/316.2, 316.7, 689, 698, 228.1, 226.11, 231.81, 316.1; 24/457, 531, 545, 547

[56] References Cited

U.S. PATENT DOCUMENTS 2,972,201 2/1961 Niedermayer ..... 248/316.7
5,743,414 4/1998 Baudino ..... 248/316.7
5,820,095 10/1998 Stone ..... 248/316.7

*Primary Examiner*—Anita M. King
*Attorney, Agent, or Firm*—Shlesinger, Fitzsimmons & Shlesinger

[57] ABSTRACT

A mounting element for accessories on shelves is described which has a clamp-shaped mouth (1) adapted to be coupled with an edge of a shelf and has two sides (3, 4) enclosing the edge.

According to the invention, at least one side (3 or 4) has a seating (10) on its side opposite to the one in contact with the edge, which seating is adapted to be connected by geometric coupling to a portion (13; 15) of an accessory the shape of which matches that of the seating itself.

7 Claims, 7 Drawing Sheets

MOUNTING ELEMENT FOR ACCESSORIES ON SHELVES

BACKGROUND OF THE INVENTION

The present invention relates to a mounting element for accessories on shelves, according to the classifying part of claim 1.

A known problem in this field is that of mounting accessories on shelves in a steady manner, such as for example bookends, hooks under the shelf panels, different gripping elements for hooking objects of various types, like tools in workshops for example, etc. Until now, for instance, these accessories have been mounted by merely resting a partition on a shelf or screw-fastening supports for a sliding bar under a shelf panel. For mounting of the above accessories makeshifts to be selected each time have been hitherto provided.

The object of the invention is therefore to make available a mounting element provided with a wide versatility for alternative mounting of several different accessories, which element can be applied to a shelf either upon or below the same. In addition, a mounting element of easy production and low cost should be proposed as well.

SUMMARY OF THE INVENTION

The above object is achieved by a mounting element for accessories on shelves, characterized by the features recited in the characterizing part of claim 1.

As pointed out in claim 1, by a mere element provided with a clamp-shaped mouth a wide variety of accessories can be fastened in a steady manner, which elements are correspondingly adapted to form a geometric fitting coupling with at least one seating provided in the mounting element itself.

In the simplest embodiment the seating is merely a cavity which is open at one side thereof and has a section transverse to the introduction direction of the accessory and constant or substantially constant in the introduction direction of the accessory.

In a preferred embodiment this cavity is formed of two undercut recesses extending parallel to each other in an insertion direction of the accessory for receiving corresponding fitting portions of the accessory itself. Preferably, openings in the cavity and the clamp-shaped mouth are on the same side and the mouth bottom is provided with relieves giving rise to ribs so that, in a further embodiment, it has the appropriate configuration for injection moulding of a plastic material.

Accessories can be of various types, the only important thing being that they must have a portion in the form of a runner, adapted to be introduced into the seating by fitting. Thus accessories may be bookends, hooks, a bar-carrier for double hanging hooks, clip carriers for a bracket or clip carriers for support elements of a hook-carrying bar.

BRIEF DESCRIPTION OF THE DRAWINGS

Further features and conformations may appear from the following description of a preferred embodiment shown in the figures of the accompanying drawings, in which.

DETAILED DESCRIPTION OF THE INVENTION

Figure 1:
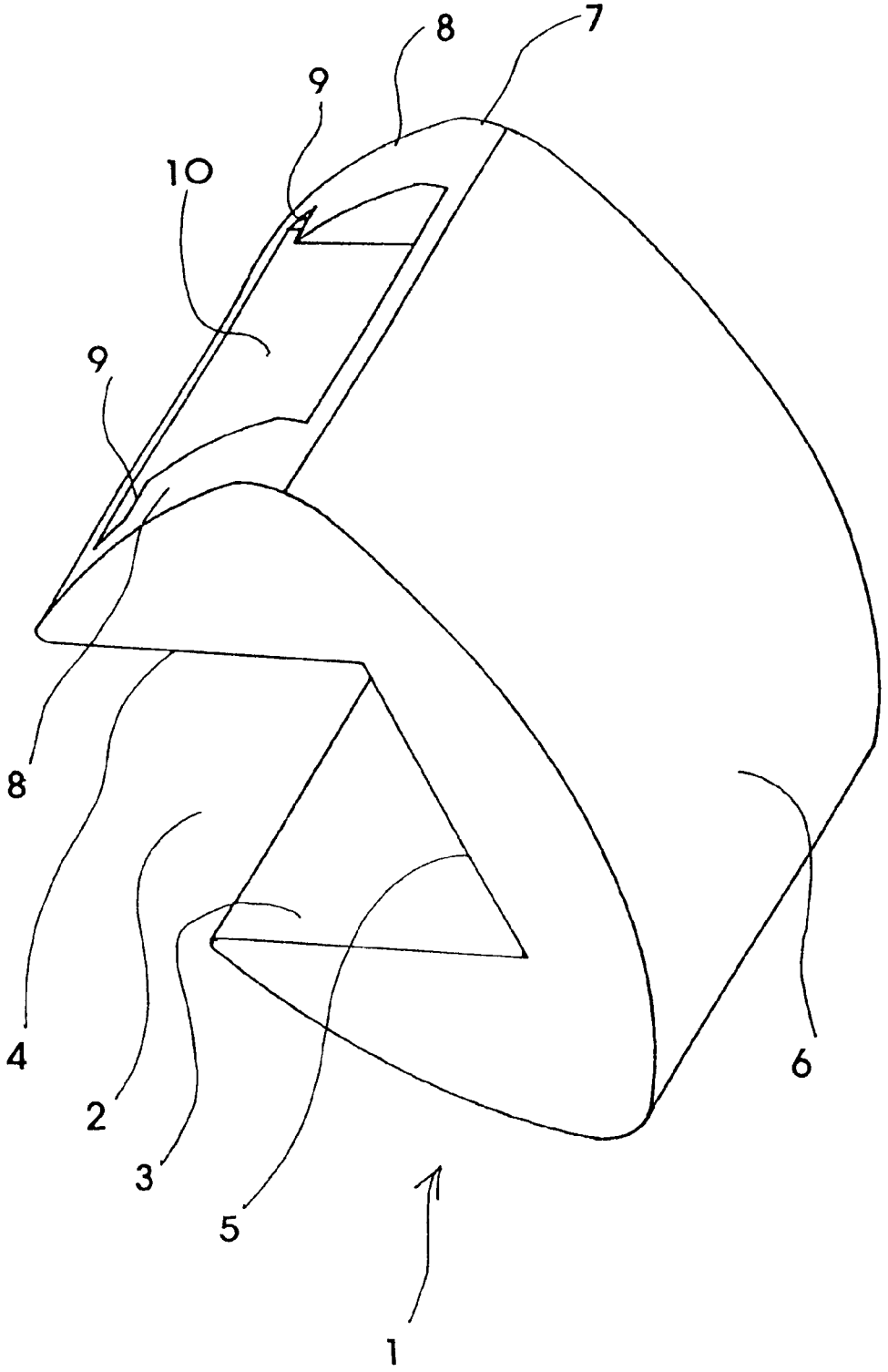
FIG. 1 is a perspective view of a mounting element in accordance with the invention.
Figure 2:
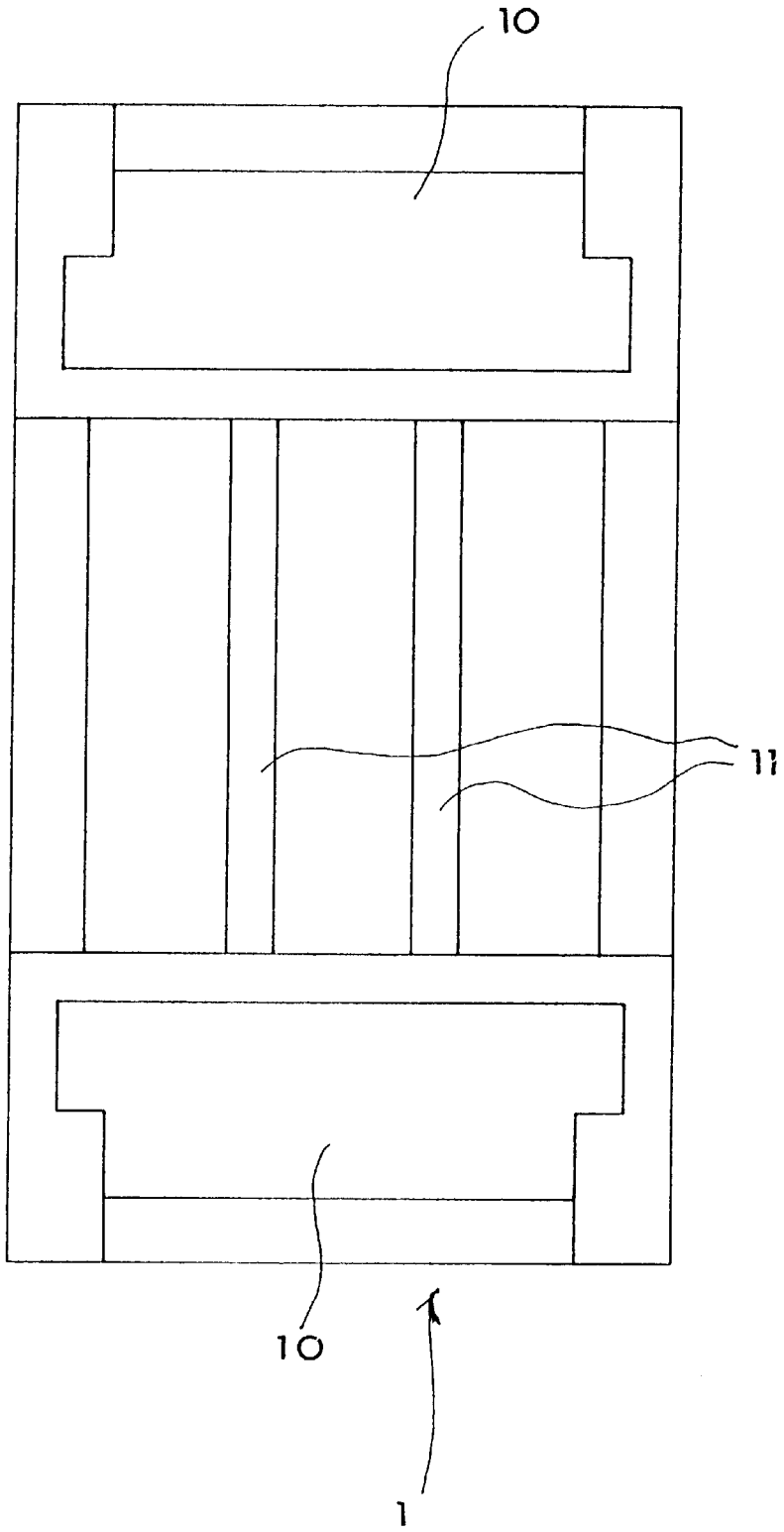
FIG. 2 is a front view, i.e. from the mouth side, of the mounting element shown in FIG. 1.

Referring particularly to FIGS. 1 and 2, a mounting element 1 has a clamp-shaped mouth 2 consisting of sides parallel to each other 3 and 4, terminating with a bottom 5 perpendicular to said sides. Bottom 5 is located at the inner side of an arched back 6 which is connected to respective curved portions 7 of sides 3 and 4. Provided in the curved portions are side walls 8 that respectively form a face surface including the mouth 2 cavity and, by means of undercut recesses 9 formed therein, also form a coupling seating 10, at each side 3, 4 of the mounting element itself. The two recesses 9 face each other and are intended for slidably and fittingly receiving projections provided on accessories to be described below by way of example.

As viewed from FIG. 2, formed in the bottom are ribs 11 giving rise to relieves for discharging the material of the mounting element 1 and making the mounting element adapted for injection moulding of plastic material.

Figure 3:
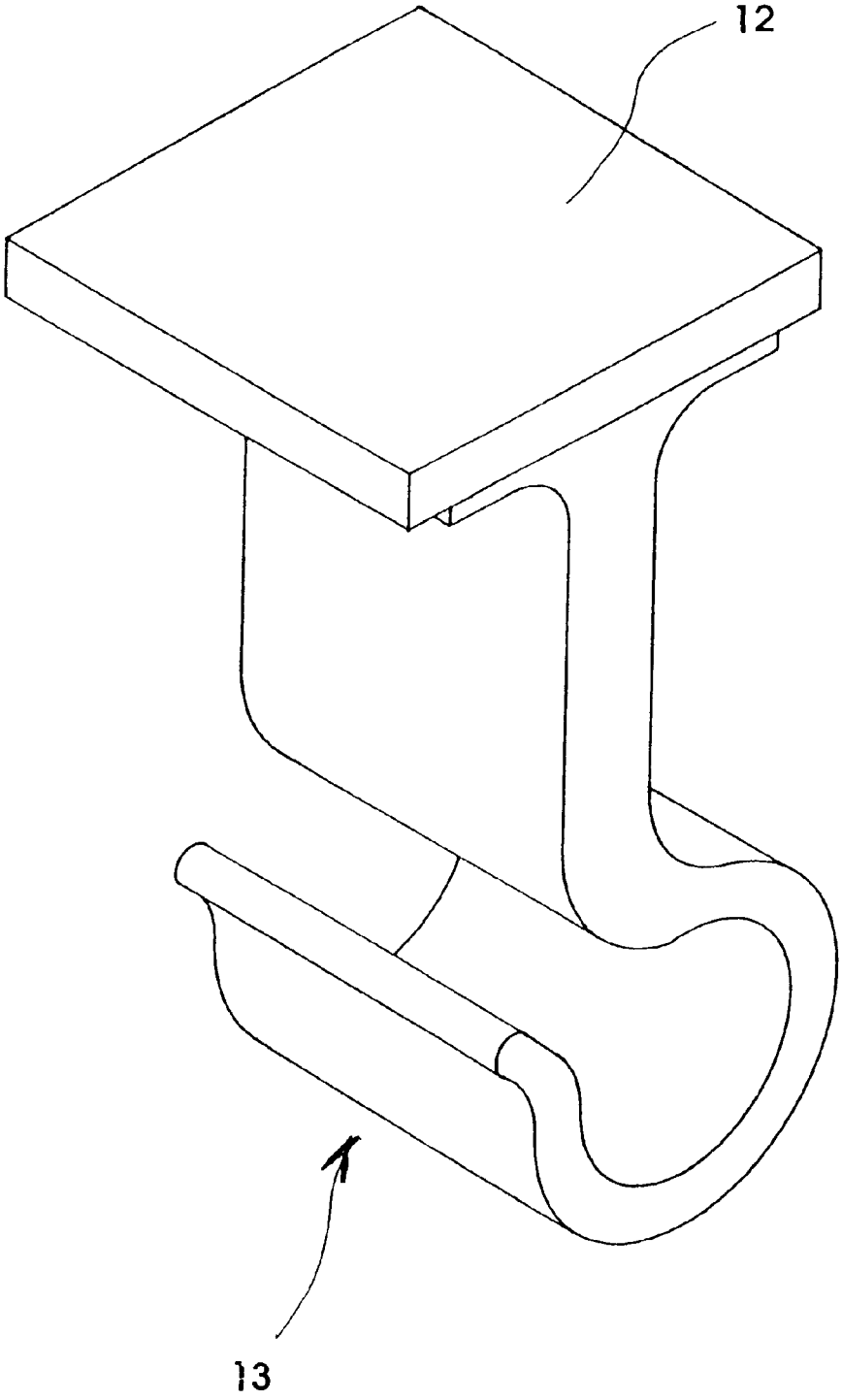
FIG. 3 is a perspective view of a hook to be coupled by fitting.

Shown in FIG. 3 is a runner or sliding block 12 for a snap-fitting hook 13. The runner 12 edges, parallel to each other, are adapted to be received in the undercut recesses 9 of the mounting element 1.

Figure 4:
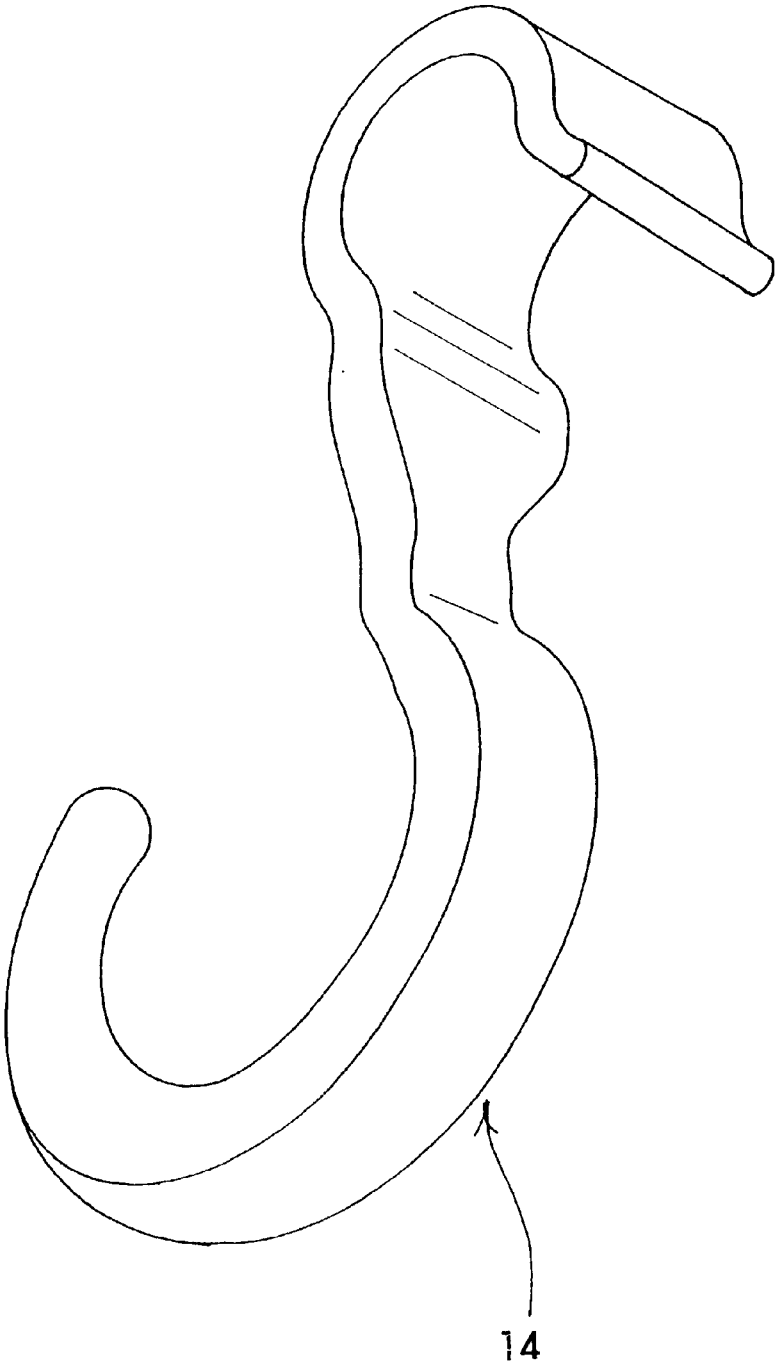
FIG. 4 is a perspective view of a double hook to be coupled by snap-fitting.

Shown in FIG. 4 is a double hook 14 adapted to be hooked to a bar received in hook 13. Thus, various objects provided with respective gripping elements can be hanging from one of the hook portions.

Figure 5:
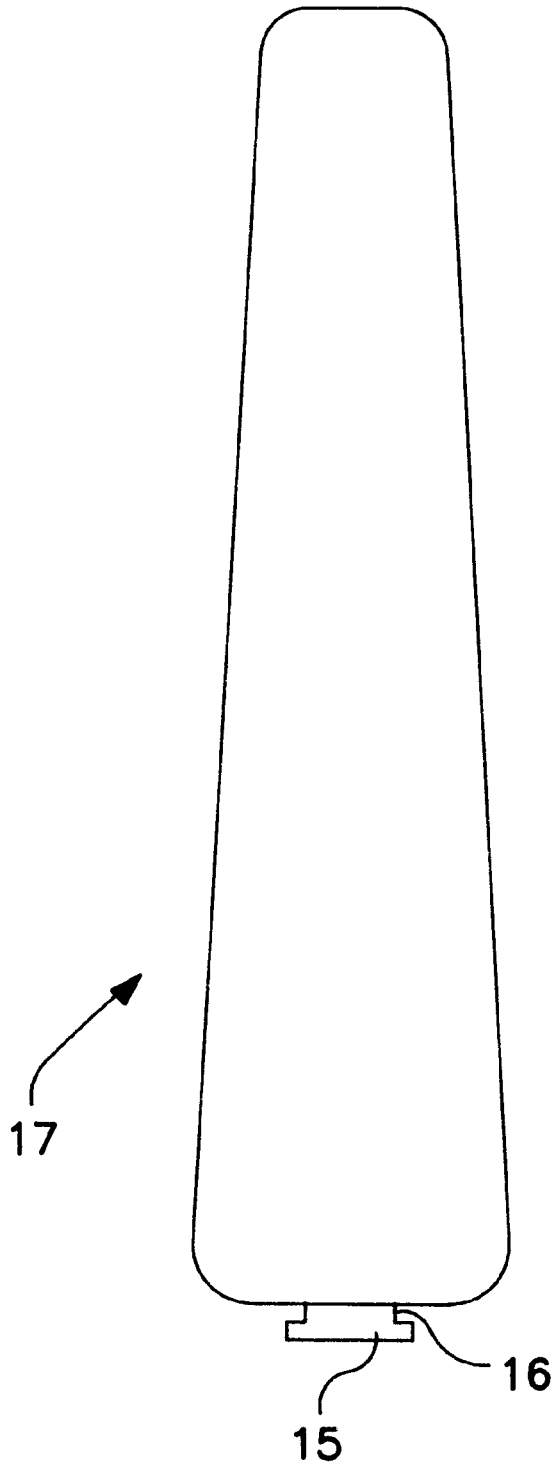
FIG. 5 is a front view of a bookend to be coupled by fitting.

Shown in FIG. 5 is a runner 15 similar to the one identified by 12, connected by a connecting portion 16 to bookends 17. Obviously, in this case also runner 15 can be received in the coupling seating 10.

Figure 6:
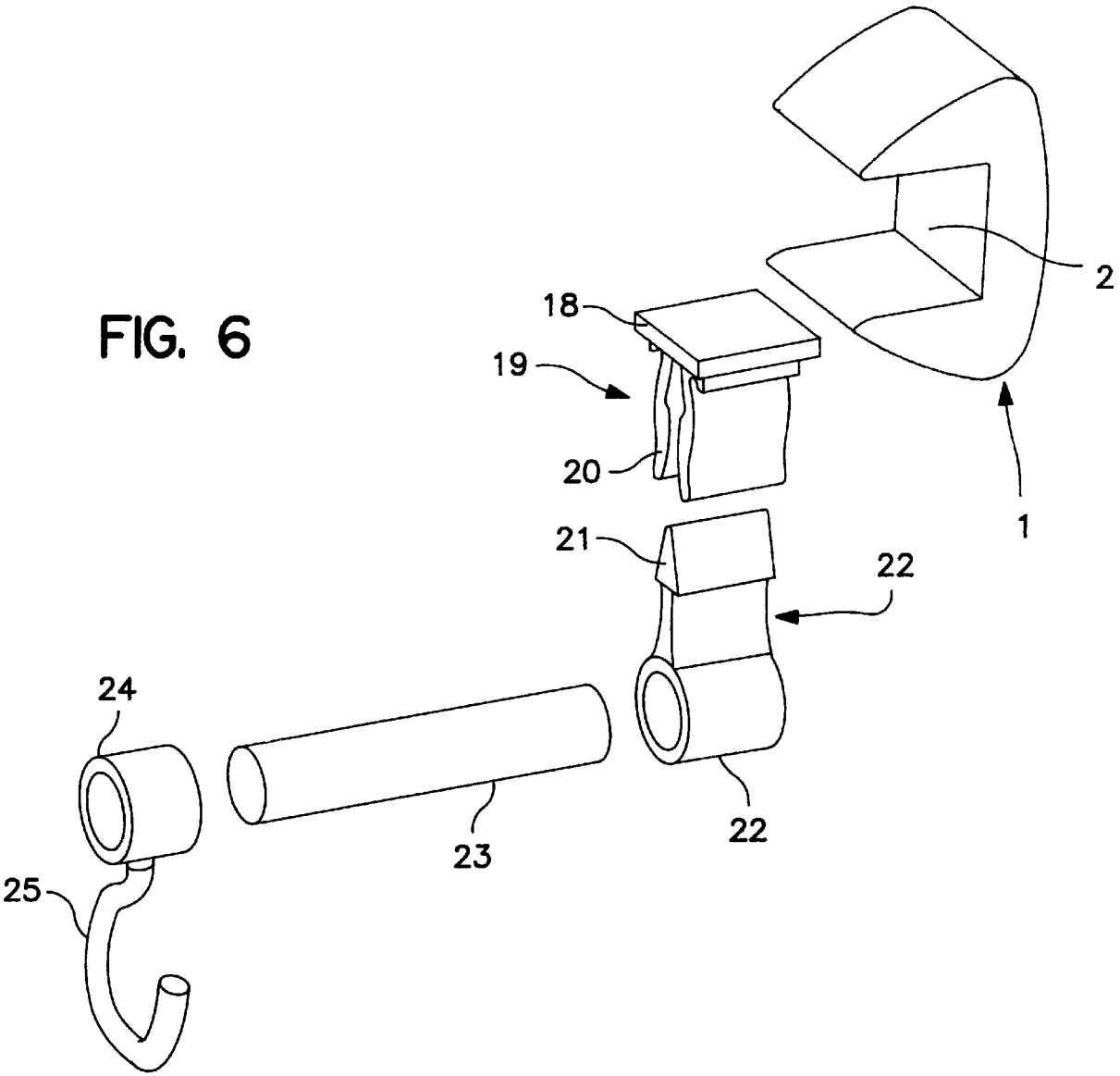
FIG. 6 is a mounting set seen in an exploded perspective view for sliding hooks.

Shown in FIG. 6 is a mounting set comprising a mounting element 1, a clip carrier 19 provided also with a runner 18, and with wings 20 adapted to be introduced into the recesses and capable of receiving and tightly holding a head 21 of a holding hush 22. Said holding bush is intended for receiving a bar 23 in its opening, which bar in turn is adapted to accept a bush 24 of a hook 25.

Figure 7:
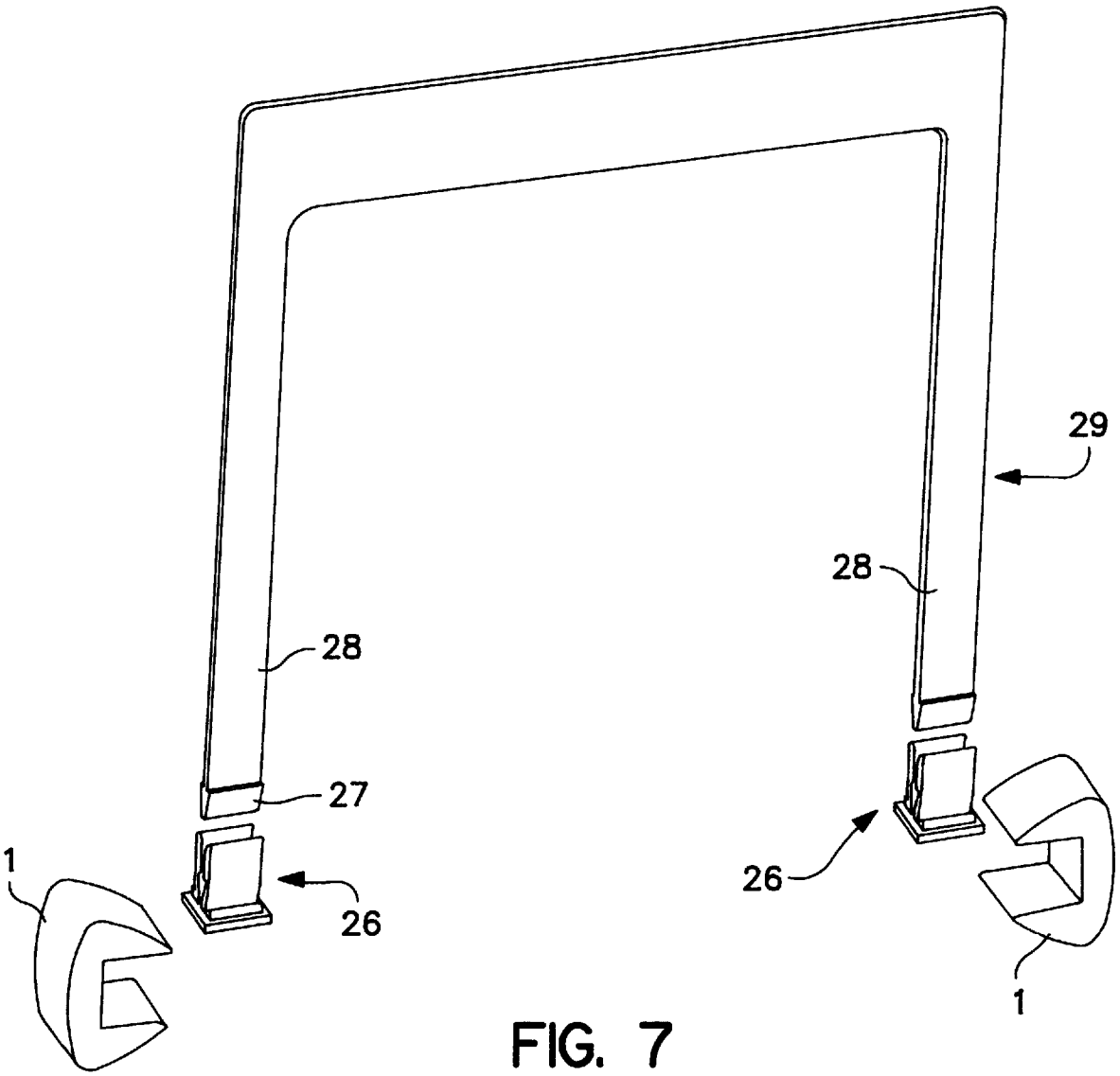
FIG. 7 is a mounting set seen in an exploded perspective view for a bracket.

Shown in FIG. 7 is a mounting set always based on a mounting element 1 with which a clip carrier 26 can be coupled, which clip carrier receives a head 27 of an arm 28 belonging to a bracket 29, in a suitable clip.

Various embodiments and variations may be provided without departing from the protection scope of the present invention: coupling between the mounting element 1 and various accessories could be also inverted. That is to say that, instead of providing the recess-shaped seating in the mounting element, said seating could be provided in the accessory, whereas a raised element, in the form of a runner for example, could be provided on the mounting element, in the same manner as described with reference to the various accessories. Thus the invention enables mounting elements of high versatility and great simplicity in manufacture to be made available, taking into account the fact that all elements can be made of plastic material.

What is claimed is:

1. A mounting element for accessories on shelves, said element having a clamp-shaped mouth adapted to be coupled with a shelf edge, and having two side walls having spaced surfaces thereof disposed to contact and enclose said edge, and characterized in that at least one of said sidewalls is provided with a seating in a surface thereof opposite to the surface thereof in contact with said edge, said seating being adapted to be connected by a geometric coupling with a portion of an accessory the shape of which matches that of said seating, said seating being a cavity of rectangular section formed in said one sidewall and adapted to slidably and fittingly receive a runner of matching conformation, said runner being provided on said accessory and having edge portions at opposite sides thereof, and said seating having formed in opposite sides thereof undercut recesses extending parallel to each other and being rectangular in cross section, and which recesses are adapted to receive the edge portions of said runner provided on said accessory, and said mouth having a bottom formed therein by a further wall extending perpendicular to said side walls, and being provided with material relieves involving formation of ribs.

2. A mounting element as claimed in claim 1, characterized in that said element is made of plastic material.

3. A mounting element as claimed in claim 1, disposed to be coupled with a bookend.

4. A mounting element as claimed in claim 1 disposed to be coupled with a bar-holding hook.

5. A mounting element as claimed in claim 4, characterized in that said element is disposed to be coupled with a bar-holding hook, which in turn is disposed to be coupled with a double hook.

6. A mounting element as claimed in claim 1, characterized in that said element is disposed to be coupled with a clip carrier for brackets.

7. A mounting element as claimed in claim 1, characterized in that said element is disposed to be coupled with a clip carrier for support elements of a hook-carrying bar.

* * * * *